US006192822B1

(12) United States Patent
Lavorata et al.

(10) Patent No.: US 6,192,822 B1
(45) Date of Patent: Feb. 27, 2001

(54) PNEUMATIC BOAT WITH AUXILIARY FLOATS

(75) Inventors: Marc Lavorata, Paris (FR); Joseph Hernando, Figueras-Girona (ES)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 09/193,494

(22) Filed: Nov. 17, 1998

(30) Foreign Application Priority Data

May 14, 1998 (FR) ..... 98 06095

(51) Int. Cl.[7] ..... B63B 7/00
(52) U.S. Cl. ..... 114/345
(58) Field of Search ..... 114/55.5, 55.54, 114/55.55, 55.57, 123, 248, 259, 283, 343, 218, 219, 345; 441/72

(56) References Cited

U.S. PATENT DOCUMENTS

| | | | | |
|---|---|---|---|---|
| 2,370,069 | * | 2/1945 | Patten | 114/345 |
| 3,056,980 | * | 10/1962 | Holladay | 441/40 |
| 4,545,319 | | 10/1985 | Ferronniere et al. . | |
| 4,603,651 | * | 8/1986 | Harding | 114/345 |
| 4,640,217 | * | 2/1987 | Ferronniere | 114/345 |
| 4,722,292 | * | 2/1988 | Marino et al. | 114/140 |
| 5,642,685 | * | 7/1997 | Garnier | 114/345 |
| 5,868,095 | * | 2/1999 | Zeromski et al. | 114/345 |

FOREIGN PATENT DOCUMENTS

| | | | | |
|---|---|---|---|---|
| 3639296 | * | 4/1988 | (DE) | 114/123 |
| 0212141 | | 3/1987 | (EP) . | |
| 0743239 | | 11/1996 | (EP) . | |
| 2398660 | | 2/1979 | (FR) . | |
| 2510064 | | 1/1983 | (FR) . | |
| 2235038 | * | 4/1988 | (FR) | 114/345 |
| 1589635 | * | 5/1981 | (GB) | 114/345 |
| 58-133990 | | 8/1983 | (JP) . | |
| 2-70591 | * | 3/1990 | (JP) | 114/345 |

* cited by examiner

*Primary Examiner*—S. Joseph Morano
*Assistant Examiner*—Ajay Vasudeva
(74) *Attorney, Agent, or Firm*—Dean W. Russell; Kilpatrick Stockton LLP

(57) ABSTRACT

A pneumatic boat comprising at least one inflatable fender (1) forming two approximately parallel branches (2) and a transom (4) extending between these two branches (2), each branch (2) being constituted by several tubular compartments (8, 9) placed side by side longitudinally and superposed having a poly-lobed cross section the major axis of which is tilted in relation to the horizontal; the lower compartment (9) of each branch (2) includes a flexible casing (11) integral with the compartment immediately above (8) and retaining a detachable float (12); the casing and the float are mutually shaped so that the float is applied by the casing against the compartment immediately above and that the external lateral part (10) of the casing is stretched approximately tangentially between these, forming with a horizontal plane an average angle of between 5 and 45° approximately.

16 Claims, 3 Drawing Sheets

PNEUMATIC BOAT WITH AUXILIARY FLOATS

The present invention concerns improvements made to pneumatic boat with auxiliary cushioning floats, comprising at least one inflatable fender forming two approximately parallel branches connecting at the front to form a bow and a transom extending between these two branches, each of the branches being constituted, at least in their approximately parallel parts, by several superposed tubular compartments placed side by side longitudinally having a poly-lobed cross section the major axis of which is inclined to the horizontal.

Boats of this type are known (see particularly FR 2 398 660, FR 2 510 054) in which a lateral canvas is fixed tangentially to some at least of the compartments on the external side of the branch being considered: they are completely satisfactory given their improved characteristics of navigability at high speeds (comfort, aptitude for keeping above the water line, heading hold, etc.) while retaining at low and medium speeds a correct immersion of the propeller, and they are enjoying considerable growth.

However, it seems desirable to modify their structure so as to make their manufacture and maintenance more straightforward and more cost effective.

To these ends, a pneumatic boat of the aforementioned type is characterized, being arranged in accordance with the invention, in that one at least of the lower compartments of each branch includes a flexible casing integral with the compartment immediately above and a detachable float retained in the said casing, and in that the said casing and the said float are mutually shaped so that the float is applied by the casing against the compartment immediately above and that the external lateral part of the casing is stretched between the said float and the said compartment immediately above extending approximately tangentially to these and forming with a horizontal plane an average angle of between 5 and 45° approximately.

In a preferred version of the type of boat targeted by the invention, each branch of the fender is formed of two inflatable compartments presenting in cross section a bi-lobed shape, and that it is the lower compartment which is constituted by a casing integral with the upper compartment and containing the above-mentioned detachable float.

Preferably also, each upper compartment possesses a section above that of the other compartments, and particularly of the detachable float.

In one possible mode of implementation, the detachable float includes at least one elongated body made of a floating material, particularly of synthetic material; in another mode of implementation, preferred since it retains the property of deflation and folding of the boat, each detachable float includes at least one inflatable elongated body. In one or other case, the float may be all in one piece or on the contrary constituted by several elongated bodies placed behind each other in the casing.

As a result of the buoyancy of the auxiliary compartment being conferred on the detachable float, the casing which contains the latter no longer has to be closed in a sealed way. Therefore, each casing may have a closed front end, preferably streamlined and pierced to advantage with at least one hole suitable to allow passage for a flexible connection enabling the float to be drawn in a deflated state into the casing for its insertion into the latter, and an open back end, preferably equipped with retaining means able to be slackened suitable for preventing the float from escaping out of the casing.

In practice, it is to advantage, in the case of an inflatable pneumatic float, that each detachable float includes a front portion with a top which is, from front to back, successively increasing, then decreasing and a consecutive portion which is approximately of cylindrical revolution.

Such an arrangement obtains a correct positioning of the tensioned casing and of the float inside the latter.

By means of the arrangement appropriate to the invention, the manufacture of auxiliary compartments is simplified. Indeed, whereas in previous boats these compartments, made sealed, had to be given different forms for the left side and the right side, in the boat of the invention, only the casings, made non-sealed, have to be different for the right and left sides. As for the floats, they are all identical and can be mounted equally well on the left or on the right, whereas it is their manufacture which is the most restricting when they come in an inflatable form given that they must then be sealed.

In addition, being detachable, inflatable floats are easier to repair in the event of a leak; they can particularly be repaired in situ, whereas the repair of an auxiliary float of a previous boat frequently required return to the workshop.

Furthermore, the detachability of the floats leaves choice in their manufacture without modification of the boat structure. They can be equally well inflatable or made of floating solid material, particularly in the form of a solid cylindrical body of synthetic foam, polystyrene, etc.

In the case of an inflatable design, the floats are protected by the casings against mechanical friction, wear and tearing particularly in rocky shallows, which increases the reliability of the boat.

Generally speaking, the improved arrangement introduced by the invention in pneumatic boats of the type targeted in the preamble proves cost effective in both manufacture and maintenance.

Lastly, it may prove to be advantageous, at least for certain applications, for the float to be at least longitudinally shaped with an approximately curvilinear triangular cross section appropriate to fill all the space defined between the casing and the adjacent compartment and to keep the casing in its position and in its shape.

The invention will be better understood by reading the following detailed description of certain preferred versions given solely as non-restrictive examples. In this description reference is made to the appended drawings in which.

Figure 1:
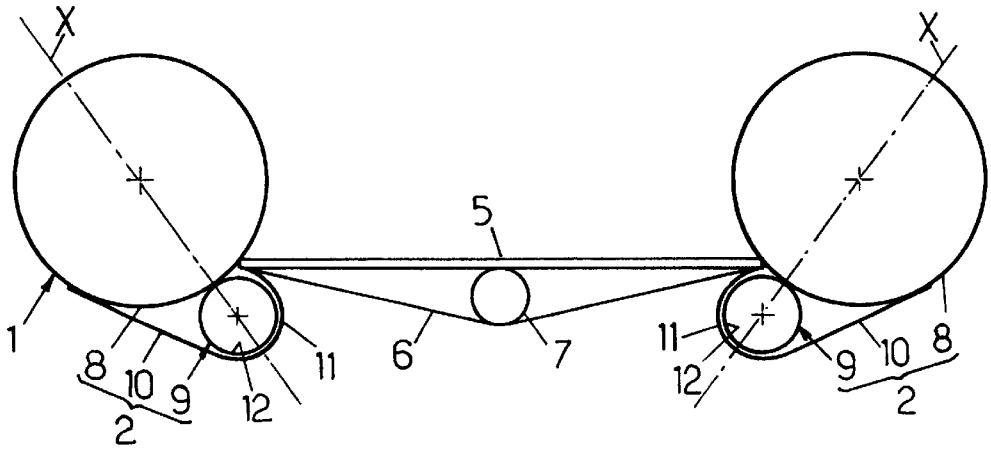
FIG. 1 shows, in a very diagrammatic way, in cross section a version of a pneumatic boat in accordance with the invention.
Figure 3:
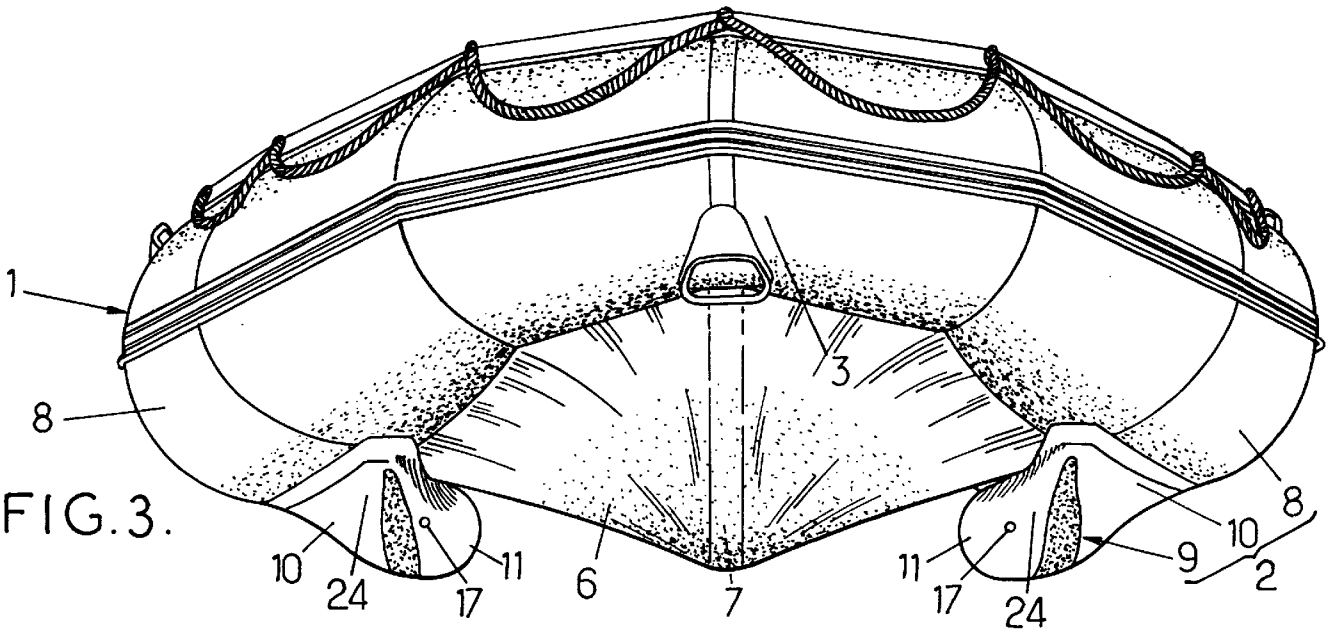
FIGS. 3 and 4 are front and back views of a practical pneumatic boat version in accordance with the diagram in FIG. 1.

Referring first to FIG. 1, a boat in accordance with the invention comprises an inflatable fender 1 forming two approximately parallel branches 2 connecting towards the front to form a bow 3 (not shown on FIG. 1; see FIG. 3).

A transom 4 (not shown on FIG. 1; see FIG. 4) connects the rear ends of the two branches 2 of the fender 1 and is intended to close in a sealed way the rear of the boat and to support at least one motor, particularly of the outboard type (not shown).

Along the two branches 2 of the boat's fender is held, internally, a floor or bottom 5 which is rigid at least crosswise. This bottom may be constituted in any appropriate manner (laths or panels made of wood or metal or of synthetic material, inflatable bottom, etc.).

A bottom canvas 6, situated under the floor 5, is connected to the fender 1 along the connection between the branches 2 of the latter and the rigid floor 5. Between the floor 5 and the bottom canvas 6 is interposed a keel 7 which stretches the canvas 6 so as to confer on it the shape of a V-shaped hull. The keel 7 may be of any appropriate type; for example, it may be a pneumatic keel constituted by at least one inflatable elongated ability as shown.

Each branch 2 of the fender 1 is constituted by several inflatable compartments, elongated (in the form of fenders), superposed and physically placed side by side while the line X joining their two respective axes is inclined; each branch thus has, in cross section, a poly-lobed shape inclined from the top to the bottom towards the interior of the boat. In the preferred version example shown in FIG. 1, each branch 2 is constituted by two superposed compartments, namely an upper compartment 8 of large section, for example circular as shown, constituting the main buoyancy component and a lower compartment 9 of smaller section constituting an auxiliary buoyancy component or auxiliary cushioning float; each branch 2 thus has in cross section a bi-lobed shape.

In the continuation of the description, reference will be made more particularly to a pneumatic boat the inflatable fender branches 2 of which have a bi-lobed architecture, as shown in FIG. 1, since it is the latter which seems bound to prove the most advantageous in practice given its simplicity of structure and the favorable advantages that it provides, it being understood however that the arrangements in accordance with the invention which are going to be described can just as well be used in a boat the inflatable fender branches 2 of which have a poly-lobed structure.

In each branch 2, the lower compartment 9 includes a flexible casing 11 integral with the upper main compartment 8 and a detachable float 12 retained in the said casing 11 and supported, when it is inflated, against the main compartment by the stretched casing.

Each casing 11 thus forms an elongated pocket which can be defined by a canvas fixed by its longitudinal edges to the main compartment 8, on the one hand, at the junction or in the neighborhood of the junction of the bottom with the main compartment and, on the other hand, at an external zone of the main compartment. Thus, the external lateral part 10 of the casing which extends between the float and the main compartment is stretched and extends approximately tangentially to these forming with a horizontal plane an average angle of between 5° and 45° approximately.

The casing 11 does not have to be sealed. To advantage it has a front end 24 which is closed, and preferably shaped as shown in FIG. 3. On the other hand, it has a rear end which is open as shown in FIG. 4 and preferably equipped with float retaining means (not shown in FIG. 4) as will be explained below.

It will be noted that the two right and left casings are of different shapes, and correspond therefore to different manufactures, when they are provided with a closed front end.

Figure 2A:
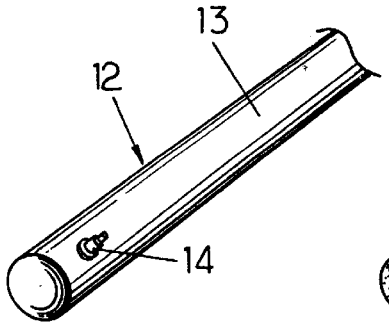
FIGS. 2A, 2B, 2C show in perspective various detachable float arrangements which can be used in the boat in FIG. 1.
Figure 2B:
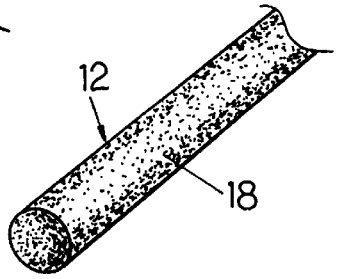
Figure 2C:
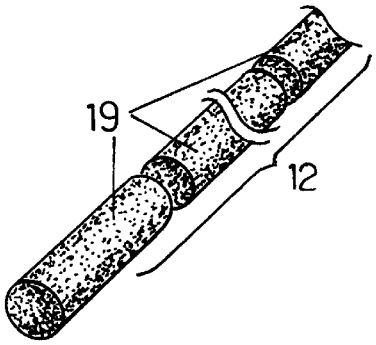

Each detachable float 12 has an elongated general shape (the shape of a black pudding roll or sausage) and can be constituted either all in one piece (FIGS. 2A and 2B), or of several end-to-end sections (FIG. 2C). The two floats are identical and can be mounted equally well on the right or on the left.

Figure 4:
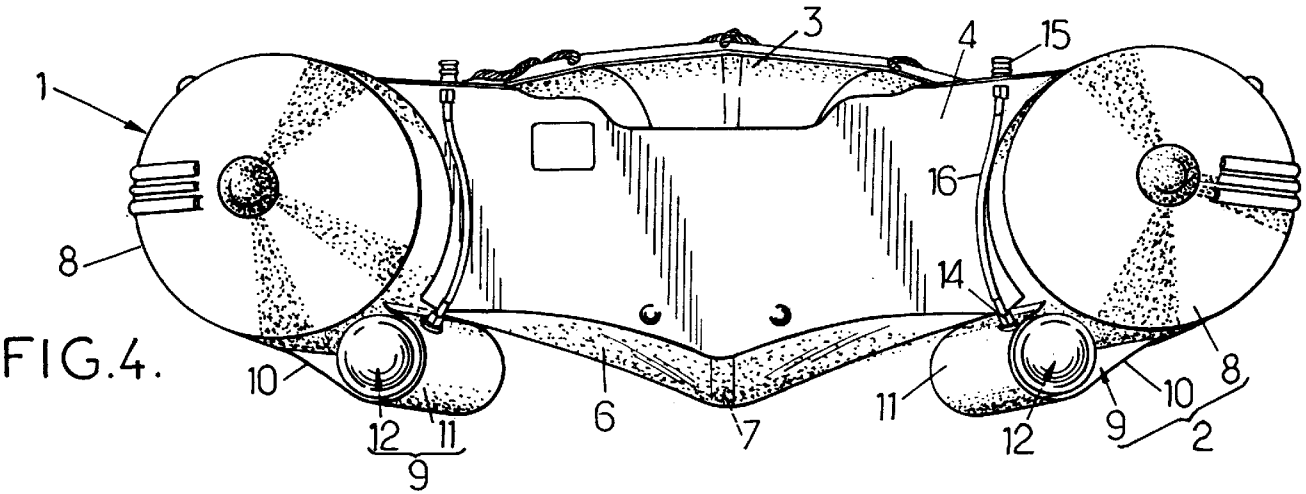
Figure 5:
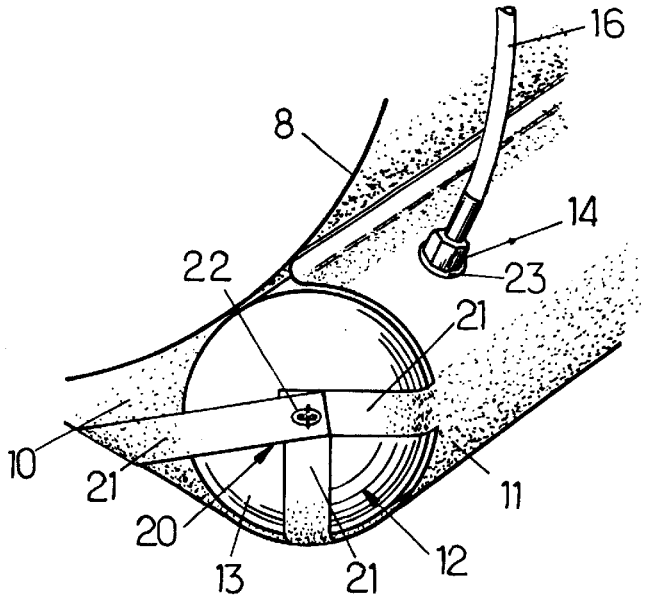
FIG. 5 is a perspective view, on a larger scale, of the back part of one of the floats of the boat in FIGS. 3 and 4.

In an advantageous version, the float 12 is an elongated inflatable body 13, equipped with an air valve 14 traversing the casing 11 through a hole 23 in the latter as shown in FIG. 5 and intended to be connected to an external inflation fitting 15 by a conduit 16 as shown in FIG. 4, or else connected directly to the main compartment 8 for a simultaneous inflation of the two pneumatic enclosures. In this case, the constitution of the float in several end-to-end sections would require either pneumatic connections between the sections for their simultaneous inflation, or the equipping of each section with an air valve; in all cases, the manufacture would be costly and it seems desirable for a pneumatic float 13 to be constituted all in one piece. The insertion of such a float in a deflated state, therefore without rigidity, into the casing 11 can be carried out to advantage by traction, from the front, by means of a flexible connection (not shown) integral with the front end of the float. To this end, it is necessary to provide a hole 17 (FIG. 3) in the front end of each casing to allow passage at the place of traction.

Figure 7:
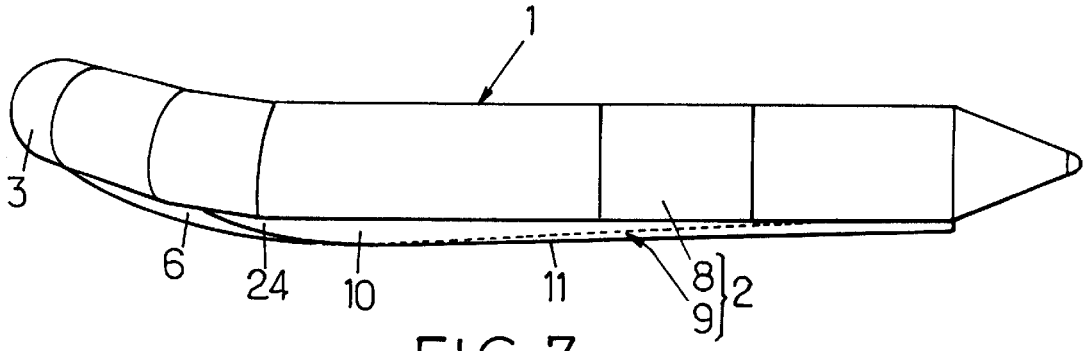
FIG. 7 is a diagrammatic side view of the inflatable boat in FIGS. 3 and 4.

In addition, in a preferred version, the elongated inflatable body 13 is not simply of cylindrical revolution over its whole length, but has a vertically bulging portion in the front as is shown particularly in FIG. 7: thus the inflatable body 13 has a vertical dimension, which from the front to the back, is firstly increasing, then decreasing and finally approximately constant (end part of cylindrical revolution), whereas the transverse dimension of the body 13 remains approximately identical.

The complex shape thus implemented (see the front view in FIG. 3) produces a wedging effect of the inflatable body 13 inside the casing 11 which keeps it in place in the latter in the moved inwards position which is quite visible in the rear view in FIG. 4. It is this moved inwards positioning which leads to the formation of the inclined canvas portion 10 which improves the performance of the boat.

It is also possible to constitute each float 12 in the form of an elongated body made of a material of lower density than water, particularly of a synthetic material such as a synthetic foam with closed pores or a solid material such as polystyrene or the like. The elongated body may be all in one piece as shown in 18 in FIG. 2B. However, to facilitate stowing and transporting the deflated and dismantled boat, it may prove more advantageous to constitute the float in several sections 19 (FIG. 2C) placed end-to-end inside the casing 11. Whether it is a solid block or in several sections, the float thus constituted can be easily inserted inside the casing 11 by reason of the rigidity, even low, of the constituent material.

By means of the arrangements in accordance with the invention which have just been explained, the two right and left floats are identical, less costly to manufacture and perfectly interchangeable. Not only the manufacture, but especially the maintenance of the boat are greatly facilitated from this point of view.

Although the float 12 is wedged by the casing 11 against the main compartment 8, it is however preferable to equip the rear end (and also the front end if the latter is not closed) of the casing 11 with retaining means 20, as shown in FIG. 5. These means, which constitute a simple safety measure, can be made simply and cheaply, for example in the form of two or three tabs 21 which extend radially from the edge of the casing 11 and the free ends of which overlap one another towards the centre of the float 12; a ring integral with the underneath tab, engaged through holes in the two other superposed tabs, and a locking pin engaged in the projecting part of the said ring constitute closure means 22 which are simple, effective and inexpensive.

Figure 6:
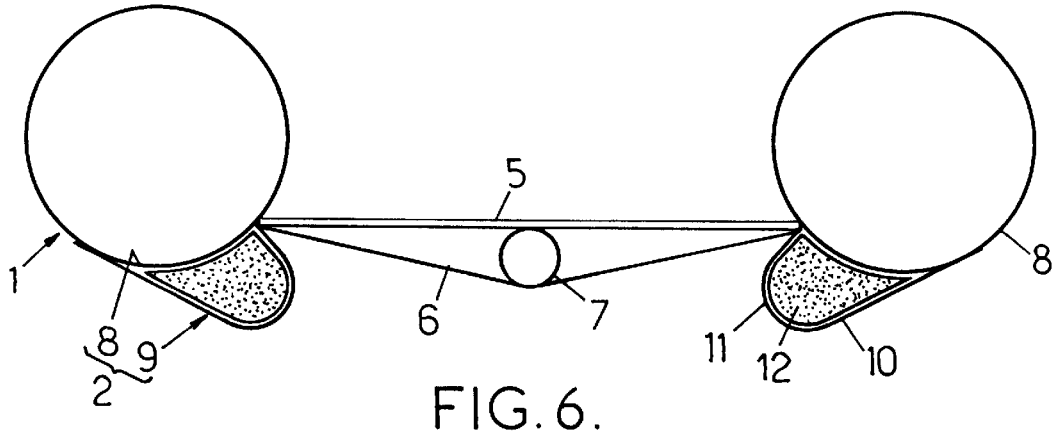
FIG. 6 is a very diagrammatic view, in cross section, of a simplified version variant of a pneumatic boat in accordance with the invention.

The structure of the auxiliary compartment 9 which has just been described in detail in relation to FIGS. 1 to 5 is the one which seems bound to confer in a reliable way the best results and advantages. However, at least for certain applications, it is possible, as shown in FIG. 6, to give the float 12, at least in a longitudinal part (front part for example), a cross section of complex shape, taken as a whole triangular curvilinear, conforming in shape as closely as possible with the external outline of the main compartment 8 and the internal outline of the casing 11, in such a way that it occupies all the volume between the casing 11 and the wall of the main compartment 8, in such a way also that it cannot slide around the compartment 8. In this specific case, an inflatable pneumatic float could certainly be considered, but would be difficult and costly to manufacture, and it seems preferable to use a solid float made of floating material.

What is claimed is:

1. A pneumatic boat comprising at least one inflatable fender forming two approximately parallel branches connecting frontwards to form a bow and a transom extending between these two branches, the branches being comprised, at least in their approximately parallel parts, by tubular compartments placed side by side longitudinally and superposed having a poly-lobed cross section defining a major axis, the major axis being inclined in relation to the horizontal, and in which at least one of the compartments of each branch includes a flexible casing (i) having an external lateral part and (ii) integral with the compartment immediately above and a detachable float retained in the same casing, and in that the casing and the float are shaped so that the float is applied by the casing against the compartment immediately above and that the external lateral part of the casing is stretched between the float and the compartment immediately above extending approximately tangentially to the float and the compartment immediately above and forming with a horizontal plane an average angle of between 5 and 45° approximately.

2. A boat in accordance with claim 1, in which each branch of the fender is formed of inflatable upper and lower compartments, having in cross section a bi-lobed form, and in which the lower compartment is at least partially enclosed by the casing integral with the upper compartment and containing the detachable float.

3. A boat in accordance with claim 1, in which the compartments constitute upper and lower compartments, each upper compartment possessing a section above that of the lower compartment and the detachable float.

4. A boat in accordance with claim 1, in which each detachable float includes at least one elongated body made of a floating synthetic material.

5. A boat in accordance with claim 4, in which each detachable float is all in one piece.

6. A boat in accordance with claim 4, in which each detachable float includes a plurality of elongated bodies placed behind each other in the casing.

7. A boat in accordance with claim 1, in which each detachable float includes at least one inflatable elongated body.

8. A boat in accordance with claim 7, in which each detachable float is all in one piece.

9. A boat in accordance with claim 7, in which each detachable float includes a plurality of elongated bodies placed behind each other in the casing.

10. A boat in accordance with claim 1, characterized in that each detachable float includes a portion which is approximately of cylindrical revolution.

11. A boat in accordance with claim 1, characterized in that the float is, at least partly longitudinally, shaped with an approximately curvilinear triangular cross section.

12. A boat in accordance with claim 1, in which each casing has front and rear ends, the front end of which is closed.

13. A boat in accordance with claim 12, in which the closed front end of each casing is streamlined.

14. A boat in accordance with claim 12, in which the closed front end of each casing is pierced with at least one hole suitable to form a passage for a flexible connection enabling the float to be drawn into the casing for its insertion into the latter.

15. A boat in accordance with claim 12, in which the open rear end of each casing is provided with retaining means able to be slackened and suitable to prevent the float from escaping out of the casing.

16. A boat in accordance with claim 12, in which each rear end is open.

* * * * *